US005085371A

United States Patent [19]

Paige

[11] Patent Number: 5,085,371

[45] Date of Patent: Feb. 4, 1992

[54] FOAM CREATING NOZZLE SYSTEM

[75] Inventor: Clive R. Paige, Winkfield, England

[73] Assignee: Shop-Vac Corporation, Williamsport, Pa.

[21] Appl. No.: 538,535

[22] Filed: Jun. 15, 1990

[51] Int. Cl.[5] ..... 239 428.5; 239 432; B05B 7/30; B05B 7/04

[52] U.S. Cl. ..... 239/343

[58] Field of Search ..... 239/343, 428.5, 432; 169/15

[56] References Cited

U.S. PATENT DOCUMENTS

| | | | |
|---|---|---|---|
| 2,774,583 | 12/1956 | Haftke | 239/428.5 |
| 2,967,570 | 1/1961 | Nurkiewicz | 169/15 |
| 3,388,868 | 6/1968 | Watson et al. | 239/428.5 |
| 3,424,250 | 1/1969 | Thomae | 239/428.5 |
| 3,701,482 | 10/1972 | Sachnik | 169/15 |
| 3,946,947 | 3/1976 | Schneider | 239/428.5 |
| 4,830,790 | 5/1989 | Stevenson | 239/428.5 |
| 4,969,603 | 11/1990 | Norman | 239/428.5 |

FOREIGN PATENT DOCUMENTS

| | | | |
|---|---|---|---|
| 636410 | 12/1978 | U.S.S.R. | 239/428.5 |

*Primary Examiner*—Andres Kashnikow
*Assistant Examiner*—Karen B. Merritt
*Attorney, Agent, or Firm*—Ostrolenk, Faber, Gerb & Soffen

[57] ABSTRACT

A nozzle assembly for producing a mousse-like mixture of air and a foamable liquid (preferably a detergent) includes a housing defining a passageway having an upstream and a venturi tube located in the passageway downstream of a mixing chamber also located in the passageway. Openings are formed in the housing to permit a first stream of ambient air to enter into the mixing chamber. The foamable liquid is injected into the mixing chamber and then into the venturi tube in such a manner that ambient air is pulled into the mixing chamber through the openings and is mixed with the foamable liquid as it passes through the venturi tube and a mousse-like mixture of air and the foamable liquid is created downstream of the venturi tube. The resulting mousse travels through the passageway and out the downstream end of the passageway. A plurality of openings are placed downstream of the venturi tube to permit a second stream of ambient air to enter into the passsageway downstream of the venturi tube to increase the velocity at which the mousse-like mixture exits the downstream end of the passageway. To further agitate the mixture a fine grating is placed against the downstream end of the venturi tube, upstream of the second air stream openings.

10 Claims, 1 Drawing Sheet

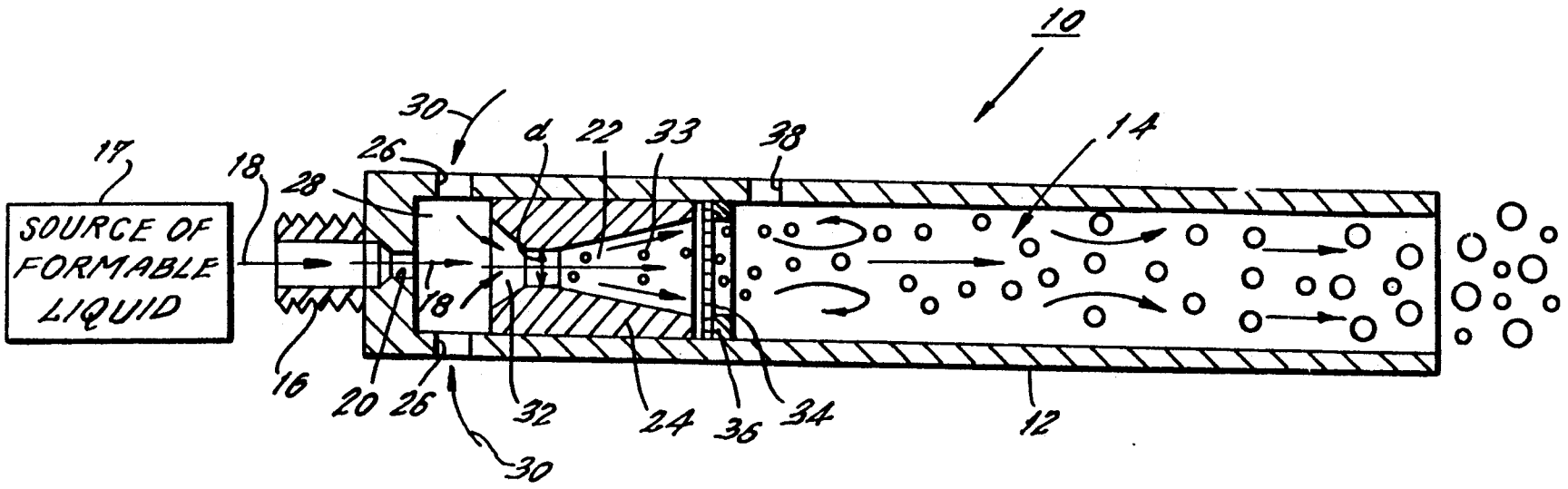
10
14
12
38
34
36
33
24
22
d
32
30
30
26
18
26
20
28
16
18
17
SOURCE OF FORMABLE LIQUID

FOAM CREATING NOZZLE SYSTEM

BACKGROUND OF THE INVENTION

The present invention relates to a foam forming nozzle system and more particularly to a nozzle system which adds air to a water/chemical mixture so as to form a foam-like mousse. Nozzles of this general type are particularly, but not exclusively, useful in connection with a pressure washer of the type disclosed in copending application Ser. No. 07/297,620 entitled PRESSURE WASHER and filed Jan. 17, 1989.

A pressure washer of the foregoing type generates a pressurized stream of liquid (preferably water) and chemicals (preferably detergent) which are used for cleaning purposes. The present invention may be utilized, however, with any foamable liquid.

In some instances, it is desirable to apply the foamable liquid to a surface to be cleaned in a foam-like mousse form. The resulting mousse adheres to the surface being cleaned and maintains the foamable liquid on the surface for a longer period of time

BRIEF DESCRIPTION OF THE INVENTION

The present invention forms the desired foam mousse utilizing a nozzle system which adds air to the foamable liquid and creates a desired degree of turbulence to entrain the air in the foamable liquid, thereby forming a mousse-like mixture. To this end, the nozzle system of the present invention comprises a housing defining a passageway having an upstream end and a downstream end;

a venturi tube located in the passageway at a location downstream of a mixing chamber also located in the passageway;

means for permitting a first stream of ambient air to enter said mixing chamber;

means for injecting a stream of foamable liquid from a source external to said nozzle assembly into said mixing chamber and then into said venturi tube in such a manner that ambient air is drawn into said mixing chamber and mixed with said foamable liquid as said foamable liquid passes through said venturi tube and a mousse-like mixture of air and said foamable liquid is created downstream of said venturi tube and travels through said passageway and out said downstream end of said passageway; and means for permitting a second stream of ambient air to enter into said passageway at a location downstream of said venturi tube to increase the velocity at which said mousse-like mixture exits said downstream end of said passageway.

In the preferred embodiment, the passage way has a generally cylindrical shape. The means for permitting a first stream of ambient air to enter into the mixing chamber preferably comprises at least one opening formed in the housing. Ambient air is pulled into the mixing chamber as the jet stream of foamable liquid passes through the mixing chamber. The jet stream of foamable liquid forms a partial vacuum in the mixing chamber which draws the ambient air into the mixing chamber.

The means for permitting the second stream of ambient air to enter into the passageway to a location downstream of the venturi tube preferably includes at least one opening formed in the housing at a location downstream of the venturi tube. A grate is preferably located immediately downstream of the venturi tube to provide further mixing of the foamable liquid and the ambient air which is passed through the venturi tube.

Other features and advantages of the present invention will become apparent from the following description of the invention which refers to the accompanying drawing.

BRIEF DESCRIPTION OF THE DRAWINGS

The sole figure is a cross-sectional view of a nozzle system in accordance with the presently preferred embodiment of the invention.

DETAILED DESCRIPTION OF THE PREFERRED EMBODIMENT

Referring now to the drawing, wherein like numerals indicate like elements, there is shown in the single figure a cross-sectional view of a nozzle system constructed in accordance with the principles of the present invention and designated generally as 10.

Nozzle system 10 includes an outer housing 12 which defines a tubular passageway 14. The housing 10 is formed out of metal, plastic or other suitable material. An externally threaded coupling 16 is connected to the upstream end of the housing 12 and includes external threads adapted to be coupled to mating internal threads (not shown) forming part of a pressurized source of foamable liquid 17. The pressurized source of foamable liquid 17 (shown schematically in the figure) is preferably, although not necessarily, the pressure washer described in copending application Ser. No. 07/297,620 replaced by Ser. No. 07/577,801. This source of foamable liquid 17 preferably supplies a foamable liquid mixture under low pressure, the outlet line pressure typically being on the order of 100 psi.

The foamable liquid enters the coupling 16 as indicated by arrows 18 and passes through a restricted opening 20. The restricted opening 20 (preferably circular in cross-section) serves to pressurize the foamable liquid entering the housing 12 and to set up a jet stream of foamable liquid indicated by arrow 22. The jet stream of foamable liquid has a significantly higher velocity than the velocity of the foamable liquid entering the threaded coupling 16 and is injected into a venturi tube 24.

At least one opening 26 is formed in the housing 12 upstream of the venturi tube 24 to permit ambient air to enter the mixing chamber 28 located upstream of venturi tube 24. The ambient air is drawn into the mixing chamber 28 as a result of the partial vacuum created in the mixing chamber 28 by the fast-moving jet stream 22 exiting opening 20. The ambient air will be pulled into the venturi tube 24 as indicated by arrows 30 and will be entrained into the jet stream of foamable liquid as the foamable liquid enters the decreasing diameter portion 32 of the venturi tube.

This will create a mousse-like mixture of air and foamable liquid in the expanding diameter portion 33 of the venturi tube 24. To further agitate the mixture and create a thicker, richer foam, a fine grating 34 is positioned downstream of the venturi tube 24, preferably immediately adjacent the downstream end of venturi tube 24.

In the preferred embodiment, the venturi tube 24 is permanently fixed in place by welding, gluing or otherwise The grating 34 is held against the downstream end of the venturi tube 24 by a fixing ring 36 which is preferably snap-fit into place.

The resulting mousse exiting the grating 34 will ultimately be applied to the surface to be cleaned. In most applications, it is desirable for the stream of mousse exiting the downstream end of the passageway 14 to continue several feet in a fairly defined stream before it impinges upon the surface being cleaned. It is therefore desirable to insure that the mousse exiting the downstream end of the passageway 14 have sufficient velocity to travel several feet and have sufficient definition over this distance to maintain a fairly constant stream.

To maintain the desired stream shape, it is preferable that the length of the passageway 14 downstream of the grating 34 be relatively long, preferably from 3 to 6 inches. The ratio of the length of the passageway downstream of the grating 34 to the diameter of the passageway is preferably from 4:1 to 8:1. While this increased length will better define the stream exiting the passageway 14, the frictional forces (resulting from surface adhesion) between the mousse and the walls of the passageway 14 will significantly reduce the speed at which the mousse flows down the passageway. Due to this reduced velocity, the mousse exiting the housing 12 will travel a relatively short distance.

To overcome this problem, the present invention utilizes one or more openings 38 into the housing 12 downstream of the grating 34. In the preferred embodiment, a single opening 38 is provided. This opening permits additional ambient air to be mixed with the mousse located downstream of the opening 38. This additional air significantly increases the velocity of the mousse moving through the downstream end of the passageway 14, therefore permitting the mousse to leave the housing 12 with a sufficient velocity to travel the distance desired.

As shown by the arrows located downstream of the grating 34, the mousse immediately downstream of the grating 34 is fairly turbulent and tends to travel in all directions. As the mousse continues traveling towards the downstream end of the passageway 14, the direction of travel of the mousse will become more uniform and more parallel to the axis of the passageway 14. By the time mousse leaves the housing 12, it moves in a substantially uniform direction parallel to the axis of the housing 12.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A nozzle assembly, comprising:

a housing defining a passageway having an upstream end and a downstream end;

a mixing chamber toward said passageway upstream end;

a venturi tube located in said passageway downstream of said mixing chamber;

first means in said passageway into said mixing chamber for permitting a first stream of ambient air to enter said mixing chamber;

second means for injecting a stream of a foamable liquid from a source external to said nozzle assembly into said mixing chamber and then into said venturi tube in such a manner that ambient air is drawn into said mixing chamber through said first means and is mixed with foamable liquid as foamable liquid passes through said venturi tube and a mousse-like mixture of air and foamable liquid is created downstream of said venturi tube and travels through said passageway and out said downstream and of said passageway;

third means in said passageway for permitting a second stream of ambient air to enter into said passageway at a location downstream of said venturi tube to increase the velocity at which said mousse-like mixture exits said downstream end of said passageway; and a grate in and across said passageway downstream of said venturi tube and upstream of said third means.

2. The nozzle assembly of claim 1, wherein said passageway has a generally cylindrical shape.

3. The nozzle assembly of claim 1, wherein said first means comprises at least one opening formed in said housing.

4. The nozzle assembly of claim 3, wherein said third means comprises at least one opening formed in said housing downstream of said venturi tube.

5. The nozzle assembly of claim 1, wherein said third means comprises at least one opening formed in said housing downstream of said venturi tube.

6. The nozzle assembly of claim 1, further comprising a coupling extending from an upstream end of said housing, said coupling being adapted to be matingly coupled to a source of said foamable liquid.

7. The apparatus of claim 1, wherein said source of foamable liquid is a water/detergent mixture.

8. The nozzle assembly of claim 1, wherein said passageway extends a substantial distance downstream of said grate.

9. The nozzle assembly of claim 8, wherein the ratio of the length of said passageway downstream of said grate to the diameter of said passageway is in the range of 4:1 to 8:1.

10. The nozzle assembly of claim 8, wherein the length of said passageway downstream of said grate is in the range of between 3 to 6 inches.

* * * * *